US007643898B2

(12) United States Patent
Takeda et al.

(10) Patent No.: US 7,643,898 B2
(45) Date of Patent: Jan. 5, 2010

(54) WEFT KNITTING MACHINE WITH DENSITY ADJUSTING FUNCTION, KNITTING METHOD, AND KNITTING PROGRAM

(75) Inventors: Koji Takeda, Wakayama (JP); Masaaki Yoshimura, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 72 days.

(21) Appl. No.: 11/722,836

(22) PCT Filed: Dec. 20, 2005

(86) PCT No.: PCT/JP2005/023307

§ 371 (c)(1),
(2), (4) Date: Jun. 26, 2007

(87) PCT Pub. No.: WO2006/070636

PCT Pub. Date: Jul. 6, 2006

(65) Prior Publication Data

US 2008/0167749 A1 Jul. 10, 2008

(30) Foreign Application Priority Data

Dec. 27, 2004 (JP) ..... 2004-377443

(51) Int. Cl.
*G06F 19/00* (2006.01)

(52) U.S. Cl. ..... 700/141

(58) Field of Classification Search ..... 66/64, 66/69, 71, 75.2; 700/130, 141
See application file for complete search history.

(56) References Cited

U.S. PATENT DOCUMENTS 4,554,802 A * 11/1985 Goller et al. ..... 66/71
4,686,838 A * 8/1987 Stoppazzini ..... 66/71
4,764,875 A * 8/1988 Carrotte et al. ..... 700/141
4,821,199 A * 4/1989 Kuhnert ..... 700/141
4,996,853 A * 3/1991 Brega ..... 66/27
5,369,966 A * 12/1994 Morita et al. ..... 66/132 R
5,511,392 A * 4/1996 Sawazaki et al. ..... 66/54
5,511,394 A * 4/1996 Shima ..... 66/232
5,991,929 A * 11/1999 Imboden et al. ..... 2/409
6,055,674 A * 5/2000 Imboden et al. ..... 2/409
6,845,285 B2 * 1/2005 Kakimoto et al. ..... 700/141
7,113,844 B2 * 9/2006 Komura ..... 700/141
7,218,988 B2 * 5/2007 Morita et al. ..... 700/141

FOREIGN PATENT DOCUMENTS

JP 62-62977 A 3/1987
JP 1-49816 B2 10/1989
JP 7-26294 B2 3/1995

(Continued)

*Primary Examiner*—Danny Worrell
(74) *Attorney, Agent, or Firm*—Rothwell, Figg, Ernst & Manbeck, P.C.

(57) ABSTRACT

A decision is made as to whether a fabric to be knitted is tubular or flat, and density is corrected such that knitting-start density is smaller and knitting-end density is larger for a tubular fabric. Knitting-start density is larger and knitting-end density is smaller for a flat fabric. A variable density section is provided between the end part and the central part of the fabric thus correcting the density gradually. Stitches at the end part of the fabric are prevented from becoming uneven as compared with the stitches in the central part without requiring additional hardware.

11 Claims, 5 Drawing Sheets

FOREIGN PATENT DOCUMENTS

| | | | |
|---|---|---|---|
| JP | 08-120548 | | 5/1996 |
| JP | 8-120584 | A | 5/1996 |
| JP | 2631837 | B2 | 7/1997 |
| JP | 11-50359 | A | 2/1999 |
| JP | 3092005 | B2 | 9/2000 |
| JP | 2001-3247 | A | 1/2001 |

* cited by examiner

Density +△:

Yarn is stretched out to the knitting-start section side

Density −△:

Jump stitch is captured, Yarn at opposing bed is stretched out

Density −△:

Yarn is drawn in at the time of knock-over

Density +△:

Yarn is stretched out at the time of knock-over

WEFT KNITTING MACHINE WITH DENSITY ADJUSTING FUNCTION, KNITTING METHOD, AND KNITTING PROGRAM

CROSS REFERENCE TO RELATED APPLICATION

This application is a 35 USC §371 National Phase Entry Application from PCT/JP2005/023307, filed Dec. 20, 2005, and designating the United States.

TECHNICAL FIELD

The present invention relates to knitting of a fabric using a weft knitting machine, and particularly to preventing the stitch size at an end part of the fabric from being uneven unlike the other parts.

BACKGROUND ART

Japanese Examined Patent Publication No. H7-26294 and Japanese Patent Application No. 2631837 disclose that the density is changed during the knitting of one course of a fabric. An advantage that can be obtained from this changing is that a variety of fabrics can be obtained by changing the stitch size in one course. Aside from this, the inventor has discovered that, for a tubular fabric, stitches become large at an end part on a knitting-start section (a section within the fabric in which knitting of one course is started) side, and stitches become small at an end part on a knitting-end section (a section within the fabric in which the knitting of one course is ended) side. For this reason, the stitch size at the end part of the fabric becomes uneven, and the change in the stitch size on the front fabric is completely opposite from the one on the rear fabric, thus an irregularity in the stitch sizes can be noticed easily. The inventor has also discovered that when the fabric on the knitting-start section side comes around the knitting-end section side having a small stitch size, the tubular fabric is twisted.

For a flat fabric, on the other hand, stitches at an end part on a knitting-start section side become small, and stitches at an end part on a knitting-end section side become large. By adjusting the stitch size to be even, the quality of the fabric can be improved.

DISCLOSURE OF THE INVENTION

An object of the present invention is to prevent a stitch size at an end part of a fabric from becoming uneven as compared with a stitch size in other part.

Another object of the present invention is to achieve the above object without requiring additional hardware.

The present invention is a weft knitting machine that performs knitting by reciprocally moving a carriage having a stitch cam over at least a pair of needle beds, the weft knitting machine comprising density correction means for correcting needle density of specified areas, which are a knitting-start section and a knitting-end section of a fabric, in accordance with the type of the fabric to be knitted. The density in each specified areas is, for example, fixed, but is not necessarily limited to this fixed value.

Preferably, the density correction means performs density correction such that, when circularly knitting a tubular fabric in one direction, density at the knitting-start section is smaller and density at the knitting-end section is larger as compared with density at a knitting-middle section.

More preferably, the density correction means performs density correction such that, when knitting a flat fabric, the density at the knitting-start section is larger and the density at the knitting-end section is smaller as compared with the density at the knitting-middle section.

More preferably, the density correction means is configured such that, when, at the knitting-start section of a next course, stitches are formed onto stitches formed at the knitting-end section of a current course, the density at the knitting-start section is larger and the density at the knitting-end section is smaller as compared with the density at the knitting-middle section, and such that, when, at the knitting-start section of the next course, stitches are formed onto stitches that are different from the stitches formed at the knitting-end section of the current course, the density at the knitting-start section is smaller and the density at the knitting-end section is larger as compared with the density at the knitting-middle section.

Preferably, there is provided density correction data storage means for storing, as variables of knitting conditions, correction values of the densities at the knitting-start section and the knitting-end section in relation to the density of the knitting-middle section.

Furthermore, the present invention is a method of knitting a fabric using a weft knitting machine by reciprocally moving a carriage having a stitch cam over at least a pair of needle beds, wherein density correction is performed such that, when circularly knitting a tubular fabric in one direction, density at a knitting-start section is small and density at a knitting-end section is large.

Moreover, the present invention is a program of a weft knitting machine that performs knitting by reciprocally moving a carriage having a stitch cam over at least a pair of needle beds, the program comprising a density correction command for correcting needle density of specified areas, which are a knitting-start section and a knitting-end section of a fabric, in accordance with the type of the fabric to be knitted.

Preferably, the density correction command performs density correction such that, when circularly knitting a tubular fabric in one direction, density at the knitting-start section is smaller and density at the knitting-end section is larger as compared with density at a knitting-middle section.

It should be noted in this specification that the disclosure about the weft knitting machine applies to the knitting method and the program, and the disclosure about the knitting method similarly applies to the knitting machine and program. Also, the cam of the carriage that adjusts the stitch size is the stitch cam and sometimes called "stitch needle cam". The status of the stitch cam indicates density, thus when the density is increased stitches become large, and when the density is reduced the stitches become small.

According to the present invention, the density is corrected in a specified area of the knitting-start section or the knitting-end section, thus stitches at an end part of a fabric can be prevented from having a size different from the one at other parts. The stitch size is corrected by correcting the density of the stitches, and the existing stitch cam of the weft knitting machine or an adjustment mechanism thereof can be used to perform such correction, thus additional hardware is not required.

Particularly in the case of circularly knitting a tubular fabric in one direction, stitches at the knitting-start section can be prevented from capturing a jump stitch at an end part of the tubular part or from becoming large as the yarn is stretched out from a stitch at the knitting-end section on the other side of the knitting-start section. Also, stitches at the knitting-end section can be prevented from being captured by the stitches at the knitting-start section on the other side of the knitting-end section and becoming small. In the case of a tubular fabric, since the knitting-start section and the knitting-end section face each other, an irregularity in stitch sizes can be noticed easily, whereby the fabric is twisted easily. However, when circularly knitting the tubular fabric in one direction, by performing density correction such that knitting-start density is smaller and knitting-end density is larger as compared with knitting-middle density, such disadvantages can be prevented.

In the case of knitting a flat fabric, by performing density correction such that knitting-start density is larger and knitting-end density is smaller as compared with knitting-middle density, in the case of plain knitting, the size of stitches on the knitting-end section side can be prevented from being increased and the size of stitches on the knitting-start section side can be prevented from being reduced by a circumstance in which the stitches of the previous course on the knitting-end section side draw the yarn and become large, while the stitches at the knitting-start section become small accordingly when the needle is drawn in at the time of knock-over when the carriage is reversed at the knitting-end section.

The density correction values in the tubular knitting and the plain knitting are opposite to each other in terms of plus and minus notation. In the case of a C-knitting method used for knitting a cardigan or the like, a plain-knitted end part appears on each side of an opened "C" section, and tubular-knitted end parts appear on right and left sides of the tubular part. The plain knitting is performed when, at the knitting-start section of the next course, stitches are formed on the stitches that are formed in the knitting-end section of the current course, wherein the knitting-start density is larger and the knitting-end density is smaller as compared with the knitting-middle density. Furthermore, the tubular knitting is performed when, at the knitting-start section of the next course, stitches are formed on stitches that are different from the stitches formed in the knitting-end section of the current course, wherein the knitting-start density is smaller and the knitting-end density is larger as compared with the knitting-middle density. In this manner, whether to increase or decrease density at each end part can be automatically determined based on knitting data.

The optimum density correction value is determined based on the type of yarn to be used, knitting speed, yarn-feeding conditions, and the number of stitches per course. Since it is inconvenient to manually input a density correction value, preferably there is provided the density correction data storage means for storing correction values of the density of the knitting-start section and of the knitting-end section with respect to that of the knitting-middle section, as variables of the knitting conditions. Accordingly, correction data of these densities can be generated automatically. The density correction data storage means is configured as, for example, a database, but the embodiment thereof is arbitrary.

EXPLANATION OF REFERENCE NUMERALS

Figure 1:
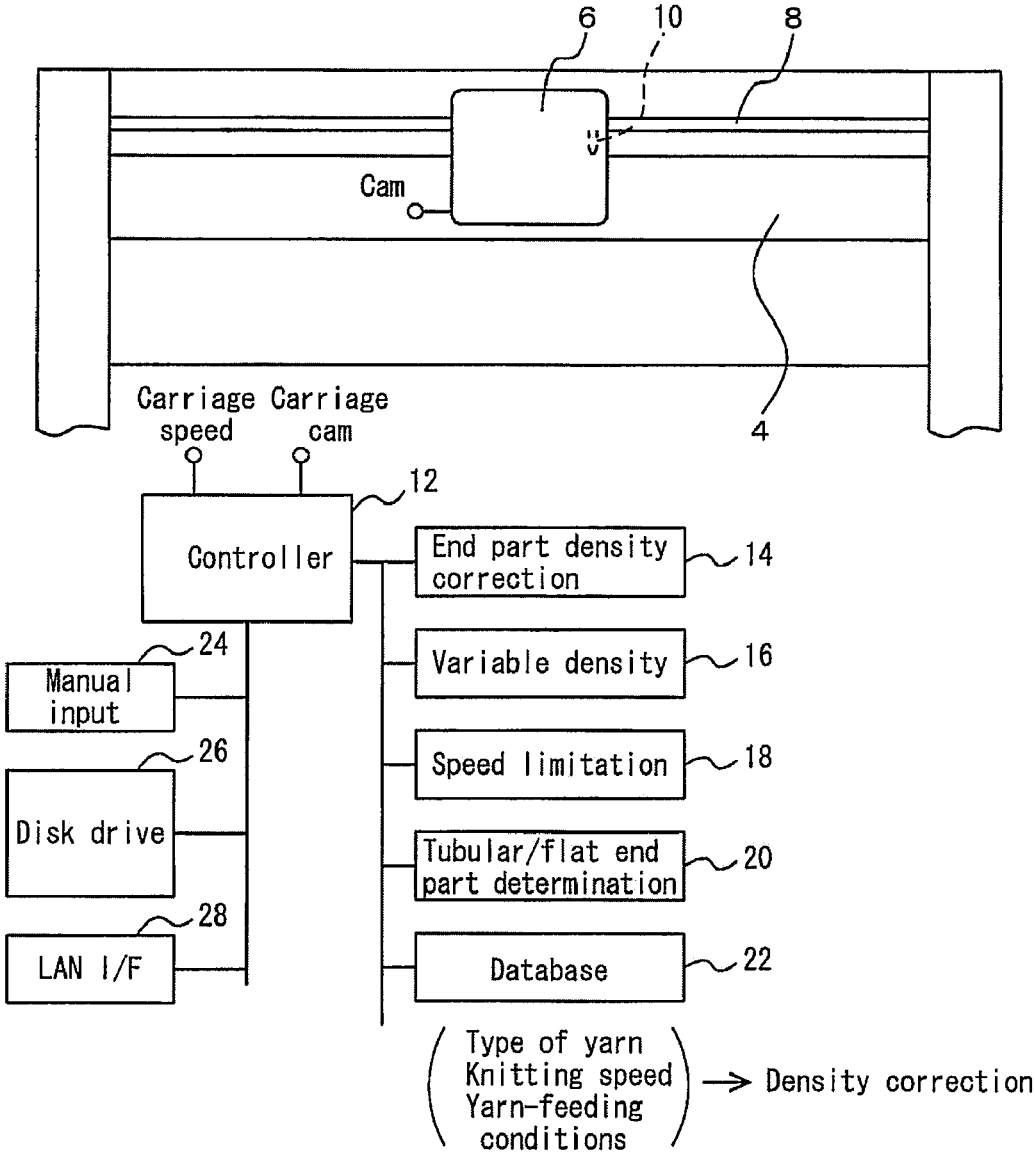
FIG. 1 is a block diagram of a weft knitting machine according to an embodiment.

2 weft knitting machine
4 needle head
6 carriage
8 conversion rail
10 yarn feeder
12 controller
14 end part density correction command
16 variable density generation command
18 speed limitation command
20 tubular/flat end part determination command
22 database
24 manual input
26 disk drive
28 LAN interface

BEST MODE FOR CARRYING OUT THE INVENTION

The best mode for carrying out the present invention is described hereinafter.

Embodiment

FIG. 1 through FIG. 8 show the embodiment. In each of these figures, 2 represents a weft knitting machine that has two or four needle beds 4, wherein a carriage 6 reciprocally travels over the needle beds 4, whereby knitting is performed. The carriage 6 has one or a plurality of known cam systems, each of which has a stitch cam for adjusting, for example, a stitch size, and an adjustment mechanism thereof. 8 represents a conversion rail for guiding a plurality of yarn feeders 10, and this rail leads the yarn feeder 10 by means of, for example, the carriage 6 to feed a yarn to the needles of the needle beds 4. Besides these parts, the weft knitting machine 2 is provided with a traveling controller of the carriage 6, but the explanation thereof is omitted.

12 represents a controller of the weft knitting machine that is integrated with the weft knitting machine 2. The controller 12 is provided with a ROM for storing an end part density correction command 14, which is a command to correct density of each end part of a fabric with reference to the central part of the fabric (knitting-middle section). A variable density generation command 16 is a command to gradually change a density value from the value of each end part to the value of the central part in accordance with a predetermined number of needles positioned between each end part and the central part of the fabric. A section that is the target of this command is referred to as a variable density section. A speed limitation command 18 is a command to limit the traveling speed of the carriage, in the case in which density adjustment speed is equal to or lower than the traveling speed of the carriage because the width of the variable density section is narrow and the correction value of the stitch needle cam with respect to the end parts is large. Specifically, the traveling speed of the carriage is limited when the ratio between the number of needles in the variable density section and the difference between the density of the knitting-start section or knitting-end section and the density of the knitting central part is equal to or lower than a predetermined value. The scope of limiting the traveling speed may be limited to the variable density section or the entire knitting width.

A tubular/flat end part determination command 20 is to determine, based on knitting data, whether the end parts of the fabric to be knitted are end parts of a tubular fabric or end parts of a flat fabric. For example, in the case of a flat fabric, the knitting-end section of the current course and the knitting-start section of the next course are in the same needle bed, and in the case of a tubular fabric that is knitted circularly in one direction, the knitting-end section of the current course and the knitting-start section of the next course are in separate needle beds. When assuming that a loop transferring is used between the current course and the next course, in the flat fabric, regardless of whether the stitches formed at the knitting-end section of the current course have a course where the loop transferring is performed, stitches are formed at the knitting-start section of the next course. In the tubular knitting fabric, if a course that is not knitted is ignored on stitches that are different from the stitches formed at the knitting-end section of the current course, stitches are formed at the knitting-start section of the next course. In this manner, the knitting data is used to determine whether the end parts of the fabric to be knitted are the end parts of the tubular fabric or the end parts of the flat fabric. The end part density correction command 14 through the tubular/flat end part determination command 20 are stored in, for example, the ROM of the controller 12, which is not shown. Alternatively, instead of configuring these commands as the commands on the ROM, they may be configured as specific control means such as end part density correction means.

The database 22 stores various types of data required for correcting the densities of the end parts. The type of the yarn, knitting speed, yarn-feeding condition, and the number of stitches per course are taken as variables, and when the end parts of the fabric are determined as the end parts of the tubular fabric or the end parts of the flat fabric, data items that are related to density correction performed at the end parts is outputted. The data required for density correction indicates how much the density at the knitting-start section should be corrected and how wide the section for performing density correction should be, or indicates how much the density at the knitting-end section should be corrected and how wide the section for performing density correction should be. The amount of density correction is expressed in, for example, the amount of change in the density of each of the end parts with respect to the density of the section between both end parts of the fabric, i.e., the central part of the fabric. Also, the variable density section needs to be provided between the knitting-start section or knitting-end section and the fabric central part to determine the width of this section. Furthermore, a threshold value for determining whether the traveling speed needs to be limited or not is preferably stored in the database 22. The data related to the density correction is determined based not only on the type of fabric to be knitted, i.e., a tubular fabric or a flat fabric, but also on the type of the yarn, the knitting speed, and the yarn-feeding conditions that the yarn is fed from the right side or the left side of the needle beds 4. Therefore, the database 22 is configured such that, once these items are defined, the density correction data is defined accordingly.

The data stored in the database 22 may be constituted such that a reference value is written in advance before shipment of the weft knitting machine so that a user can change the data using the weft knitting machine, or may be constituted as fixed data. Also, the density correction data may be inputted from a manual input 24 in each case. Furthermore, the density correction data may be written into the knitting data and supplied to the controller 12.

24 represents a manual input that is used for manually inputting data required for operating the weft knitting machine 2. 26 represents a disk drive that is used for reading the knitting data and the like stored in a disk or the like. 28 represents a LAN interface that is used for inputting the knitting data and the like from a LAN. The controller 12 outputs a signal for controlling the cam of the carriage and a signal for controlling the traveling speed of the carriage, and thereby controls the stitch cam of the carriage 6 and the traveling speed of the carriage 6. In the case in which the traveling speed of the carriage is controlled, the traveling speed of the carriage that is obtained when operating the stitch cam with respect to the needles in the variable density section is controlled.

Figure 2:
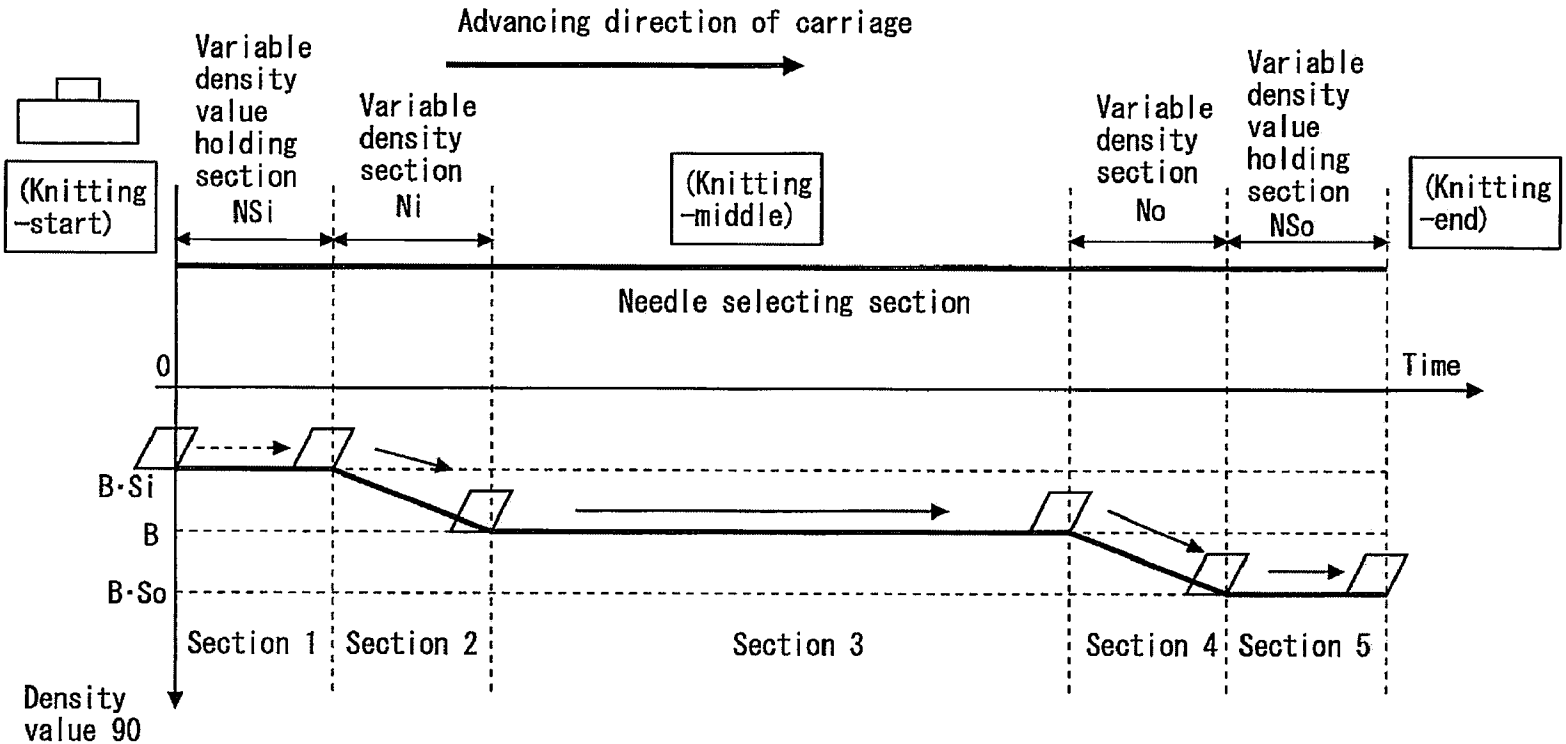
FIG. 2 is a figure showing a model of density correction performed at end parts according to the embodiment.

FIG. 2 shows a model of the density correction performed in a fabric that is circularly knitted in one direction. The carriage travels from the left side to the right side in the figure, wherein the left side represents the knitting-start section, the right side represents the knitting-end section, and the knitting-middle section in the center represents the fabric central part. B indicates a value of the density at the knitting central part, Si indicates an adjusted value of the density at the knitting-start section, and S0 indicates an adjusted value of the fabric at the knitting-end section. NSi indicates a section in which the density at the knitting-start section is corrected to a fixed value, and Ni indicates the variable density section on the knitting-start section side. NS0 indicates a section in which the density at the knitting-end section is corrected to a fixed value, and N0 indicates the variable density section on the knitting-end section side. The width of each section NSi, NS0 for setting the density to the fixed value (specified section) and the width of each variable density section Ni, N0 is, for example, approximately 0.5 inches through 2.0 inches (12 mm through 50 mm), and the values of S0 and Si and the value of B are preferably around 5% or within a range of 8% through 2%.

The number of needles in these sections varies in accordance with a gauge of the knitting machine, thus it is arbitrary to refer to the length of the needles or the number of needles to determine the width of each of the sections. Further, the width of each section and each adjusted value of density are preferably defined based on the knitting speed, the type of the yarn, and the like, and it is particularly preferred to define them on the basis of the database of the database 22.

Figure 3:
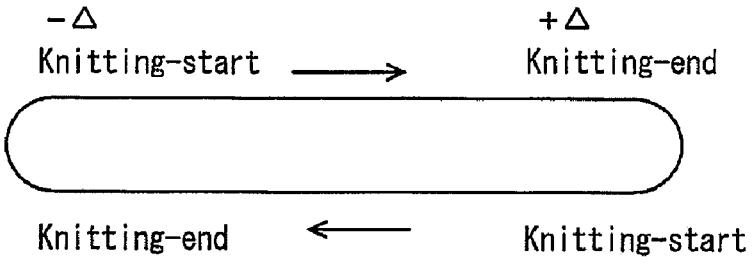
FIG. 3 is a figure schematically showing the density correction performed when tubular knitting is performed.

FIG. 3 schematically shows the density correction performed in the case of the tubular fabric. When the carriage knits the fabric circularly as shown by the arrows in the figure, the knitting-start section and the knitting-end section are positioned as shown, and the density at the knitting-start section side is reduced, while the density at the knitting-end section side is increased. It is considered that the stitch size at the knitting-start section or knitting-end section is uneven because, in the knitting-start section for example, a jump stitch between the knitting-start section and the needle bed on the opposite side is captured and thereby the stitch size is increased. It is also considered that at that moment the yarn at the bed on the opposite side is stretched out and thereby the stitch size is increased. In the knitting-end section side, on the other hand, it is considered that, when knitting is started on the knitting-start section side, the yarn is stretched out to the knitting-start section side and thereby the stitch size is reduced. It should be noted that each of the density correction values A shown in FIG. 3 through FIG. 7 indicates whether the density is increased (+) or the density is reduced (−), and thus does not mean that +A and −A are of the same absolute value of the density correction value.

Figure 4:
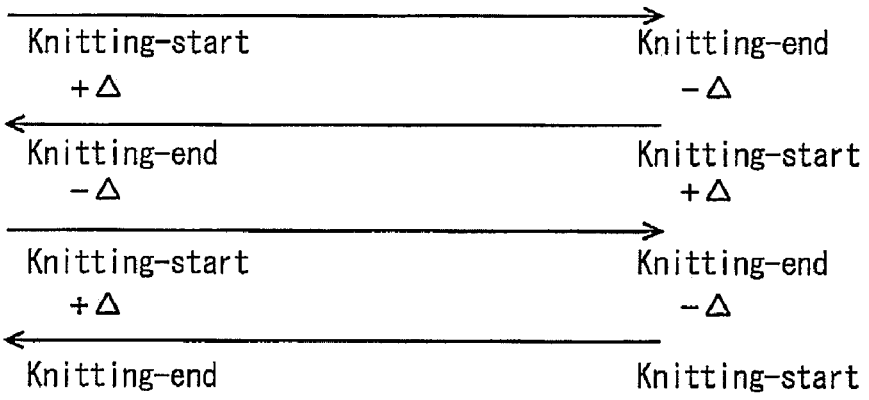
FIG. 4 is a figure schematically showing the density correction performed when plain knitting is performed.

FIG. 4 shows the density correction performed in the case of the plain knitting. Each of the arrows shown in the figure represents the traveling direction of the carriage. In the case of plain knitting, the cause of reduction in the stitch size at the knitting-start section side is that when the carriage is reversed to start knitting the knitting-start section side, the stitches on the knitting-end section side in the previous course are knocked over from the needle. It is considered that the needle is drawn in at the time of knock-over, resulting in that the yarn is drawn into the stitches on the knitting-end section side in the previous course. As a result, the size of stitches at the knitting-start section becomes small, while the size of stitches at the knitting-end section becomes large.

Figure 5:
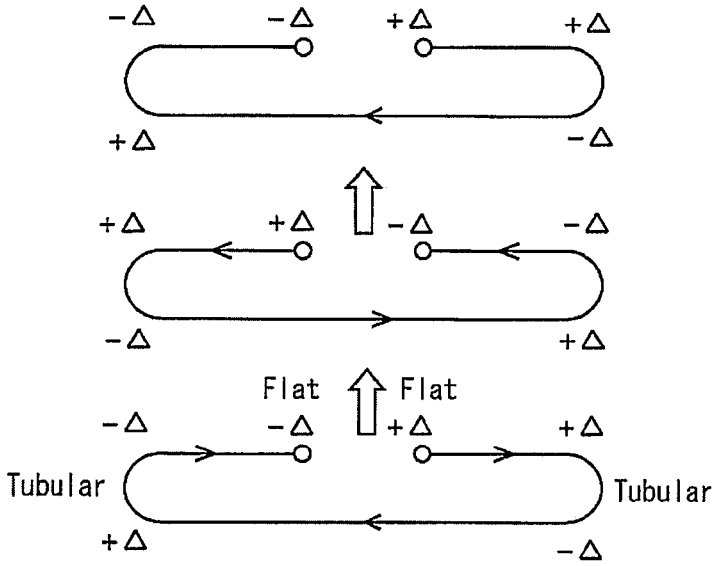
FIG. 5 is a figure schematically showing the density correction for C knitting where the tubular knitting and the plain knitting are both performed.

FIG. 5 shows the density correction for a C knitting method used for knitting a cardigan or the like. Knitting is started from the bottom to the top of the figure. End parts for the tubular knitting are positioned at both ends of the fabric, and end parts for the plain knitting are positioned at a central section of the fabric where the C is opened.

Figure 6:
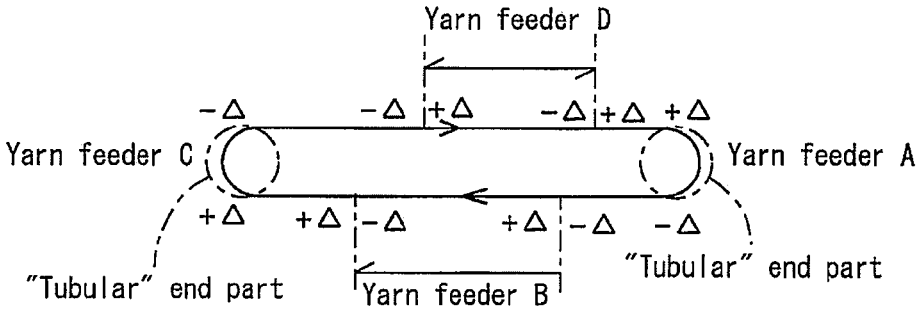
FIG. 6 is a figure schematically showing the density correction performed when the tubular knitting and intersia knitting both are performed.

FIG. 6 shows a knitting process in the tubular knitting by means of intersia knitting. In intersia knitting, the yarn feeders are changed in the middle of a course. For example, four yarn feeders A through D are used. Besides the end parts of the tubular knitting, there is a boundary of a section in the intersia knitting, which means that the knitting-end section of the plain knitting and the knitting-start section of the plain knitting exist in the boundary of the intersia section. It should be noted that the boundary of the intersia section can be detected by changing the yarn feeders on the basis of the knitting data.

Figure 7:
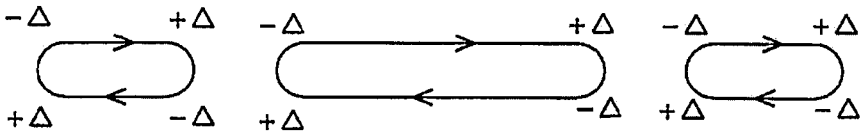
FIG. 7 is a figure schematically showing the density correction performed when knitting three tubular parts of the right and left sleeves and the body part.

FIG. 7 shows the density correction performed when circularly knitting, in one direction, three tubular parts: the right sleeve; the body part; and the left sleeve. This knitting process is the same as the process of circularly knitting the tubular parts independently, thus the knitting-start section and the knitting-end section are located at both the front fabric and the back fabric of each part. In the case of performing intersia knitting on the body part, the end parts of the body part may be configured as the ones shown in FIG. 6. In any of the cases shown in FIG. 5 through FIG. 7, whether the end parts are the end parts of the tubular fabric or the end parts of the flat fabric can be determined by means of the tubular/flat end part determination command 20.

Figure 8:
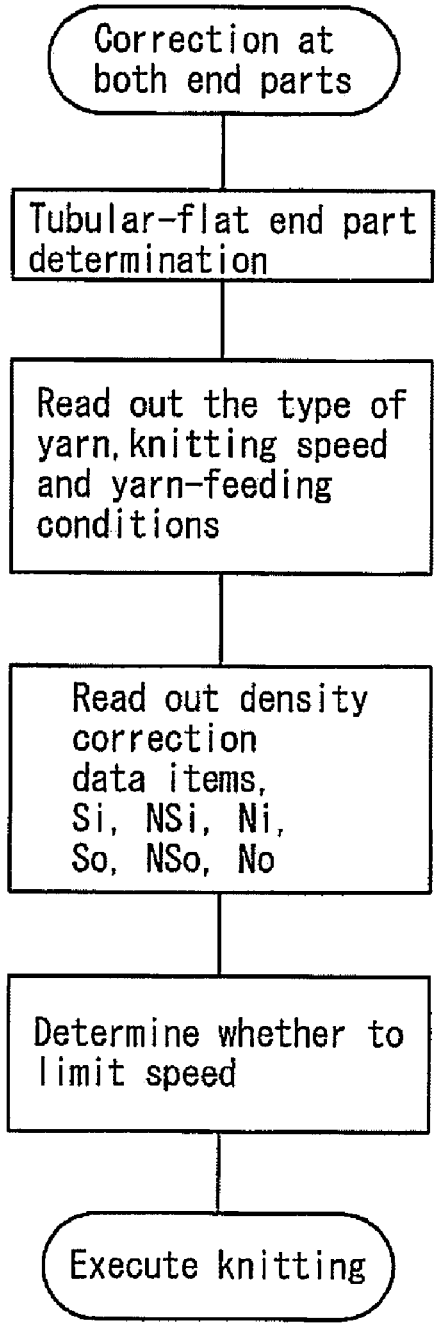
FIG. 8 is a flowchart showing a density correction algorithm according to the embodiment.

FIG. 8 shows a density correction algorithm of each end part. In a tubular/flat end part determining section, whether the end parts are the end parts of the tubular fabric or the end parts of the flat fabric is determined on the basis of the knitting data, and the type of the yarn, the knitting speed, the yarn-feeding conditions and the like are read from the knitting data. If the type of the yarn cannot be found from the knitting data, it is assumed that the type of the yarn is set to, for example, a default, and thereby the effect of the yarn type may be ignored.

Next, the density correction data is read from the database 22. The data items to be read are Si, NSi, Ni, S0, NS0 and N0. When these data items are inputted manually, input values from the manual input 24 are used. Then, whether the speed limitation needs to be performed or not is determined by using the ratio between Ni and Si and the ratio between N0 and S0. Once the density correction data for each end part is obtained in this manner, knitting is executed in accordance with the obtained density correction data.

In the present embodiment, the following effects are obtained.

(1) In both tubular fabric and flat fabric, the stitch size at each end part of the fabrics can be prevented from becoming uneven, by using the existing mechanism of the weft knitting machine.

(2) In the case in which end parts of the flat fabric and end parts of the tubular fabric exist as in C knitting or tubular knitting including intersia knitting, the type of such end parts can be automatically identified using the knitting data.

(3) By determining the type of the end parts, the density correction data can be automatically generated from the database 22.

(4) The variable density section for gradually correcting density is provided between a fabric end part and a fabric central part, thus the stitch size can be prevented from changing unnaturally between the fabric end part and the fabric central part.

(5) In the case in which the width of the variable density section is narrow, and in the case in which the density correction value of the fabric end part is large and thereby the density adjustment speed is lower than the traveling speed of the carriage, the speed of the carriage can be limited so that the changing of the density of the variable density section can be completed.

In the present embodiment, the density of each specified section is corrected by the fixed value, the variable density section is provided, and whether to limit the traveling speed of the carriage is determined. However, it is not necessary to limit the traveling speed of the carriage or to provide the variable density section.

The invention claimed is:

1. A weft knitting machine with a density adjusting function, which performs knitting by reciprocally moving a carriage having a stitch cam over at least a pair of needle beds, the weft knitting machine comprising density correction means for correcting needle density of specified areas, which are a knitting-start section and a knitting-end section of a fabric, in accordance with the type of the fabric to be knitted, whereby density at the knitting-start section and density at the knitting-end section are corrected to be in directions opposite to each other such that the density at the knitting-start section is smaller or bigger and the density at the knitting-end section is larger or smaller as compared with density at a knitting-middle section.

2. The weft knitting machine with a density adjusting function according to claim 1, wherein the density correction means performs density correction such that, when circularly knitting a tubular fabric in one direction, the density at the knitting-start section is smaller and the density at the knitting-end section is larger as compared with the density at the knitting-middle section.

3. The weft knitting machine with a density adjusting function according to claim 1, wherein the density correction means performs density correction such that, when knitting a flat fabric, the density at the knitting-start section is larger and the density at the knitting-end section is smaller as compared with the density at the knitting-middle section.

4. The weft knitting machine with a density adjusting function according to claim 1, wherein the density correction means is configured such that, when, at the knitting-start section of a next course, stitches are formed onto stitches formed at the knitting-end section of a current course, the density at the knitting-start section is larger and the density at the knitting-end section is smaller as compared with the density at the knitting-middle section, and such that, when, at the knitting-start section of the next course, stitches are formed onto stitches that are different from the stitches formed at the knitting-end section of the current course, the density at the knitting-start section is smaller and the density at the knitting-end section is larger as compared with the density at the knitting-middle section.

5. The weft knitting machine with a density adjusting function according to claim 1, further comprising density correction data storage means for storing, as variables of knitting conditions, correction values of the densities at the knitting-start section and the knitting-end section in relation to the density of the knitting-middle section.

6. A knitting method of knitting a fabric using a weft knitting machine, which performs knitting by reciprocally moving a carriage having a stitch cam over at least a pair of needle beds, said method comprising steps of:

correcting, in accordance with the type of the fabric to be knitted, needle density of specified areas, which are a knitting-start section and a knitting-end section of a fabric, so as to be in directions opposite to each other in the knitting-start section and the knitting-end section, such that the density at the knitting-start section is smaller or bigger and the density at the knitting-end section is larger or smaller as compared with density at a knitting-middle section.

7. A program, on a computer-readable medium, of a weft knitting machine that performs knitting by reciprocally moving a carriage having a stitch cam over at least a pair of needle beds, the program comprising a density correction command for correcting, in accordance with the type of fabric to be knitted, needle density of specified areas, which are a knitting-start section and a knitting-end section of the fabric, so as to be in directions opposite to each other in the knitting-start section and the knitting-end section such that density at the knitting-start section is smaller or bigger and density at the knitting-end section is larger or smaller as compared with density at a knitting-middle section.

8. The program of a weft knitting machine according to claim 7, wherein the density correction command performs density correction such that, when circularly knitting a tubular fabric in one direction, the density at the knitting-start section is smaller and the density at the knitting-end section is larger as compared with the density at the knitting-middle section.

9. The program of a weft knitting machine according to claim 7, wherein the density correction command performs density corrections such that, when knitting a flat fabric, the density at the knitting-start section is larger and the density at the knitting-end section is smaller as compared with the density at the knitting-middle section.

10. The method of claim 6, wherein in the correcting step, density correction is performed such that, when knitting a flat fabric, density at the knitting-start section is large and density at the knitting-end section is small as compared with the density at the knitting-middle section.

11. The method of claim 6, wherein in the correcting step, density correction is performed such that, when circularly knitting a tubular fabric in one direction, density at a knitting-start section is small and density at a knitting-end section is large as compared with the density at the knitting-middle section.

* * * * *